US009303389B2

(12) United States Patent
Iwamoto et al.

(10) Patent No.: US 9,303,389 B2
(45) Date of Patent: Apr. 5, 2016

(54) CONSTRUCTION MACHINE

(71) Applicant: HITACHI CONSTRUCTION MACHINERY CO., LTD., Tokyo (JP)

(72) Inventors: Yohei Iwamoto, Kagoshima (JP); Junya Kawamoto, Moriyama (JP); Osamu Kokuryou, Koka (JP); Hiroshi Tabeta, Konan (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 14/451,479

(22) Filed: Aug. 5, 2014

(65) Prior Publication Data

US 2015/0056051 A1 Feb. 26, 2015

(30) Foreign Application Priority Data

Aug. 21, 2013 (JP) ..... 2013-171222

(51) Int. Cl.

| | |
|---|---|
| ***E02F 9/08*** | (2006.01) |
| ***E02F 3/32*** | (2006.01) |
| ***E02F 9/22*** | (2006.01) |

(52) U.S. Cl.

CPC ..... *E02F 9/0875* (2013.01); *E02F 3/32* (2013.01); *E02F 3/325* (2013.01); *E02F 9/2267* (2013.01)

(58) Field of Classification Search

CPC ..... E02F 9/0875; E02F 3/325; E02F 3/32; E02F 9/2267

See application file for complete search history.

(56) References Cited

U.S. PATENT DOCUMENTS 8,919,725 B2 * 12/2014 Sayre ..... F16F 15/08 248/560
2009/0223582 A1 * 9/2009 Go ..... E02F 9/00 137/899

FOREIGN PATENT DOCUMENTS

| | | | |
|---|---|---|---|
| EP | 2098644 | A2 | 9/2009 |
| EP | 2182121 | A1 | 5/2010 |
| JP | 2000-291065 | A | 10/2000 |
| JP | 2002-155543 | A | 5/2002 |
| JP | 2010-106568 | A | 5/2010 |
| JP | 2012-17553 | A | 1/2012 |
| JP | 2012-172465 | A | 9/2012 |

OTHER PUBLICATIONS

Japanese Office Action received in corresponding Japanese Application No. 2013-171222 dated Jun. 23, 2015.
Extended European Search Report received in corresponding European Application No. 14181387.3 dated Feb. 18, 2015.

* cited by examiner

*Primary Examiner* — Faye M Fleming
(74) *Attorney, Agent, or Firm* — Mattingly & Malur, PC

(57) ABSTRACT

A control valve block is mounted on a bottom plate of a revolving frame through a control valve block mounting plate. In this case, a left support member and a right support member are provided on a back surface of the control valve block mounting plate at two spots with equal distances sandwiching a center position of gravity (G) of the control valve block. The left and right support members are mounted on a support beam provided on the bottom plate of the revolving frame. On the other hand, a weight-reducing part is provided at a part in the bottom plate of the revolving frame away from the support beam. The control valve block which is a heavy article is stably supported on the bottom plate at two spots sandwiching its center position of gravity (G). Moreover, the weight of the revolving frame can be reduced by the weight-reducing part.

5 Claims, 10 Drawing Sheets

CONSTRUCTION MACHINE

TECHNICAL FIELD

The present invention relates to a construction machine such as a hydraulic excavator provided with a control valve block for controlling various actuators, for example.

BACKGROUND ART

In general, a hydraulic excavator as a construction machine is roughly composed of an automotive lower traveling structure by a traveling motor, an upper revolving structure rotatably mounted on the lower traveling structure and provided with a prime mover for driving a hydraulic motor, and a front device provided on the upper revolving structure moved upward/downward by an actuator.

Here, the upper revolving structure is provided with a revolving frame forming a support structural body, and a control valve block mounting plate is provided on the revolving frame. A control valve block composed of a collective body of a plurality of directional control valves is mounted on this control valve block mounting plate, and supply/discharge of pressurized oil from a hydraulic pump to the traveling motor and the actuator is controlled by each of directional control valves constituting this control valve block. The configuration is such that operations of the traveling motor and the actuator can be controlled by supplying a pilot pressure according to operations of a lever, a pedal and the like to each of the directional control valves constituting the control valve block (see, Patent Document 1, for example).

PRIOR ART DOCUMENT

Patent Document

Patent Document 1: Japanese Patent Laid-Open No. 2000-291065 A

SUMMARY OF THE INVENTION

Incidentally, a small-sized hydraulic excavator called a mini shovel is usually transported to a work site in a state loaded on a deck of a truck. Thus, when the hydraulic excavator is to be transported by using a truck, the weight of the entire hydraulic excavator needs to be accommodated in a loading weight limit of the truck.

On the other hand, each of the directional control valves constituting the control valve block is formed of a robust metal block body so that it can withstand the high-pressure pressurized oil delivered from the hydraulic pump. Therefore, the weight of the control valve block made of the collective body of the plurality of directional control valves is large. Thus, when the control valve block which is a heavy article is mounted on the revolving frame, the weight of the hydraulic excavator increases, which is a problem.

On the other hand, each of the directional control valves constituting the control valve block and the actuator are connected to each other via a hydraulic line such as a hydraulic hose. Therefore, in order to arrange (piping) the hydraulic lines by avoiding various mounted equipment arranged on the revolving frame, the control valve block needs to be arranged at a high position away to the above from a bottom plate of the revolving frame.

However, in order to stably arrange the control valve block which is a heavy article at the high position of the revolving frame, the control valve block needs to be mounted on the bottom plate of the revolving frame via a large number of robust brackets and the like. As a result, addition of the weights of these brackets and the like further increases the weight of the entire hydraulic excavator, which is a problem.

In view of the above-discussed problems with the conventional art, it is an object of the present invention to provide a construction machine which is configured such that the control valve block which is a heavy article can be stably mounted on the revolving frame and the entire weight can be reduced.

(1) In order to solve the above described problems, the present invention is applied to a construction machine comprising: an automotive lower traveling structure by a traveling motor; an upper revolving structure rotatably mounted on the lower traveling structure and provided with a prime mover for driving a hydraulic pump; and a front device provided at a front-part position of the upper revolving structure and moved upward/downward by the actuator, in which the upper revolving structure is composed of: a revolving frame having a flat plate-shaped bottom plate and forming a support structural body, a control valve block mounting plate provided on the revolving frame, and a control valve block collectively mounted on the control valve block mounting plate and composed of a plurality of directional control valves for controlling supply/discharge of a pressurized oil from the hydraulic pump to the traveling motor and the actuator.

A characteristic of a configuration employed by the present invention is that at least two support members are provided at positions with substantially equal distances sandwiching a center position of gravity of the control valve block on a back surface faced with the bottom plate of the revolving frame in the control valve block mounting plate, each of these support members is mounted on the bottom plate of the revolving frame, and a weight-reducing part for reducing the weight of the bottom plate is provided on the bottom plate of the revolving frame at a position different from the position where each of the support members is mounted.

With this arrangement, since the control valve block mounted on the control valve block mounting plate can be mounted on the bottom plate with high strength at the plurality of positions sandwiching its center position of gravity, the control valve block which is a heavy article can be stably supported on the bottom plate.

In addition, by providing the weight-reducing part at the position different from the position where each of the support members is mounted in the bottom plate of the revolving frame, the weight of the revolving frame can be reduced, and the weight of the entire construction machine can be reduced. Moreover, since each of the support members is arranged at the position with the substantially equal distance sandwiching the center position of gravity of the control valve block, the control valve block can be stably supported on the bottom plate by using a minimum support member. As a result, the number of support members can be reduced, and the weight of the entire construction machine can be further reduced.

Moreover, since the control valve block can be arranged at a position higher than the bottom plate by each of the support members provided on the control valve block mounting plate, workability when each of the directional control valves constituting the control valve block and each of the actuators are connected to each other via a hydraulic line can be improved.

(2) According to the present invention, the weight-reducing part is constituted by a through hole penetrating the bottom plate of the revolving frame and/or a recessed groove recessed on the bottom plate of the revolving frame.

With this arrangement, when the through hole is provided on the bottom plate of the revolving frame, the weight of the revolving frame can be reduced, and weight reduction of the entire construction machine can be promoted. Moreover, when the recessed groove is provided on the bottom plate of the revolving frame, the weight of the revolving frame can be reduced while strength of the bottom plate is sufficiently ensured.

(3) According to the present invention, a support beam is provided in a state surrounded by the weight-reducing part on the bottom plate of the revolving frame, and the support member is mounted on the support beam.

With this arrangement, a portion surrounded by the weight-reducing part in the bottom plate of the revolving frame becomes the support beam with high strength. Thus, by mounting each of the support members provided on the control valve block mounting plate on the support beam of the bottom plate, the control valve block which is a heavy article can be supported with sufficient strength even with respect to the revolving frame having the weight reduced by the weight-reducing part.

(4) According to the present invention, each of the support members is provided on the back surface of the control valve block mounting plate at the positions with the substantially equal distances in the front-rear direction or the left-right direction by sandwiching the center position of gravity; a support beam for mounting each of the support members is provided on the bottom plate of the revolving frame; and the weight-reducing part is configured to be provided on a portion excluding the support beam.

With this arrangement, since the portion where each of the support members does not have to be mounted in the bottom plate of the revolving frame can be made the weight-reducing part, the weight of the revolving frame can be reduced, and weight reduction of the entire construction machine can be promoted.

(5) According to the present invention, the revolving frame is comprises the bottom plate extending in the front-rear direction, right and left vertical plates installed upright on the bottom plate and extending in the front-rear direction while being faced in the left-right direction, and a lateral plate installed upright in an intermediate portion in the front-rear direction of the bottom plate and extending in the left-right direction from the right vertical plate beyond the left vertical plate; and the support beam and the weight-reducing part are provided on a left front corner portion partitioned by the left vertical plate and the lateral plate in the bottom plate.

With this arrangement, the left front corner portion of the bottom plate on which the support beam and the weight-reducing part are provided can be reinforced by the left vertical plate and the lateral plate installed upright on the bottom plate. As a result, strength of the support beam can be further improved, and the control valve block which is a heavy article can be stably supported by this support beam.

MODE FOR CARRYING OUT THE INVENTION

Hereinafter, the embodiments of a construction machine according to the present invention will be explained in detail referring to FIGS. 1 to 13 by taking a case where the present invention is applied to a hydraulic excavator with a canopy specification. FIGS. 1 to 7 show a first embodiment of the present invention.

Figure 1:
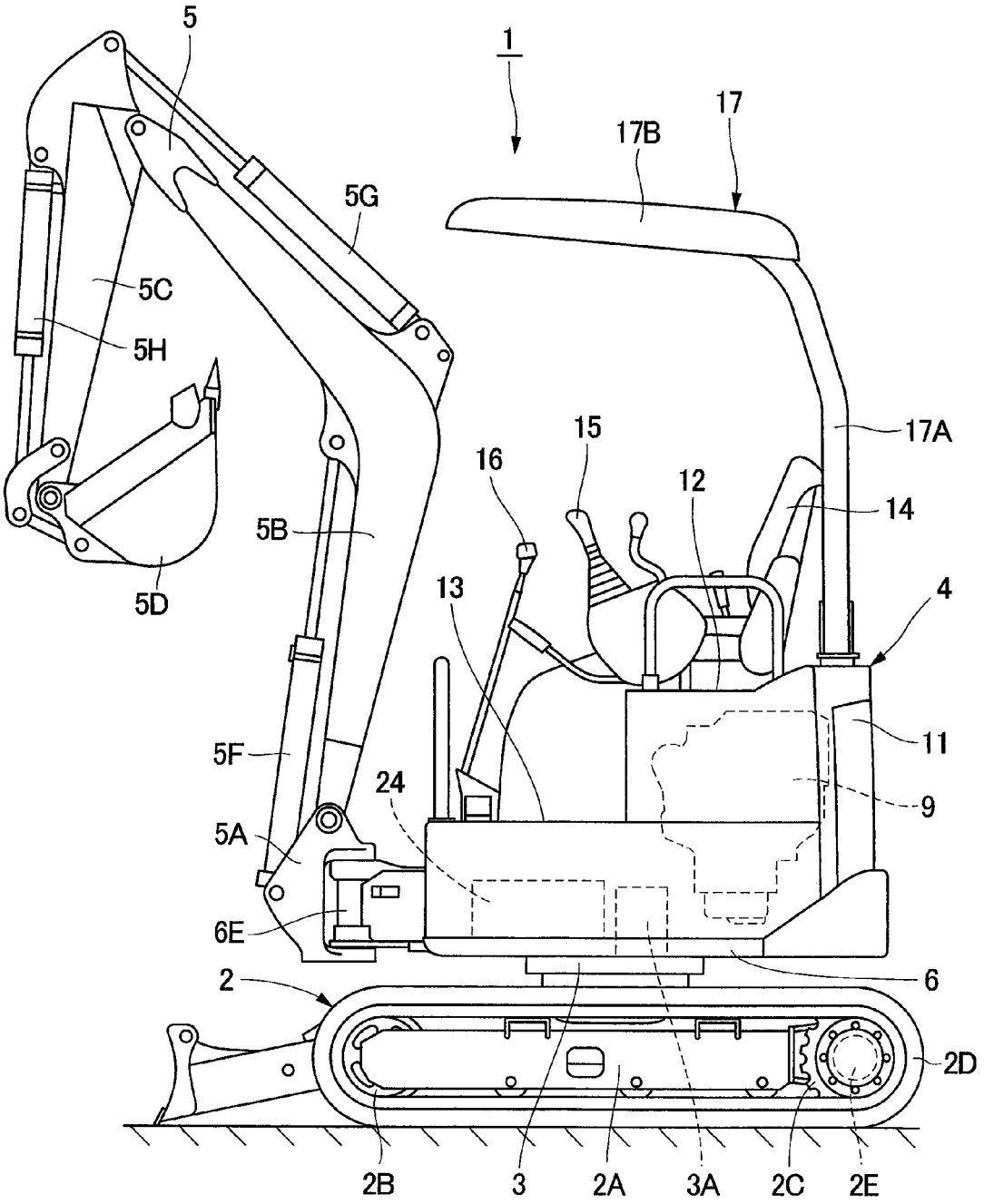
FIG. 1 is a front view showing a hydraulic excavator that is applied to the embodiment of the present invention.

In FIG. 1, a hydraulic excavator 1 with the canopy specification is a small-sized hydraulic excavator called a mini shovel suitable for a work in a small worksite. This hydraulic excavator 1 is composed of an automotive lower traveling structure 2, an upper revolving structure 4 rotatably mounted on the lower traveling structure 2 through a revolving device 3, and a swing-type front device 5 provided on a front end side of the upper revolving structure 4 and performing an excavating work of earth and sand and the like.

The lower traveling structure 2 has left and right truck side frames 2A. An idler wheel 2B is provided on one side in a front-rear direction of each of the truck side frames 2A, and a drive wheel 2C is provided on the other side in the front-rear direction of each of the truck side frames 2A. A crawler belt 2D is wound around the idler wheel 2B and the drive wheel 2C. Here, each of the left and right drive wheels 2C of the lower traveling structure 2 is provided with a traveling motor 2E as an actuator, and this traveling motor 2E is constituted by a variable capacity hydraulic motor, for example.

The revolving device 3 has a revolving motor 3A as an actuator formed of a hydraulic motor or the like. By driving this revolving motor 3A, the upper revolving structure 4 can be revolved on the lower traveling structure 2.

On the other hand, the front device 5 is composed of a swing post 5A provided on a front end side of a revolving frame 6 which will be described later, capable of swing in the left-right direction, a boom 5B provided on the swing post 5A, capable of moving upward/downward, an arm 5C mounted on a tip end side of the boom 5B, capable of moving upward/downward, a bucket 5D rotatably mounted on the tip end side of the arm 5C, a swing cylinder 5E for swinging the swing post 5A, a boom cylinder 5F for moving the boom 5B upward/downward, an arm cylinder 5G for moving the arm 5C upward/downward, and a bucket cylinder 5H for rotating the bucket 5D. Each of the cylinders 5E, 5F, 5G, and 5H constitutes an actuator.

Subsequently, the upper revolving structure 4 is composed of the revolving frame 6, an engine 9, a counterweight 11, an operator's seat 14, a canopy 17, a control valve block mounting plate 18, a control valve block 24 and the like which will be described later.

Figure 2:
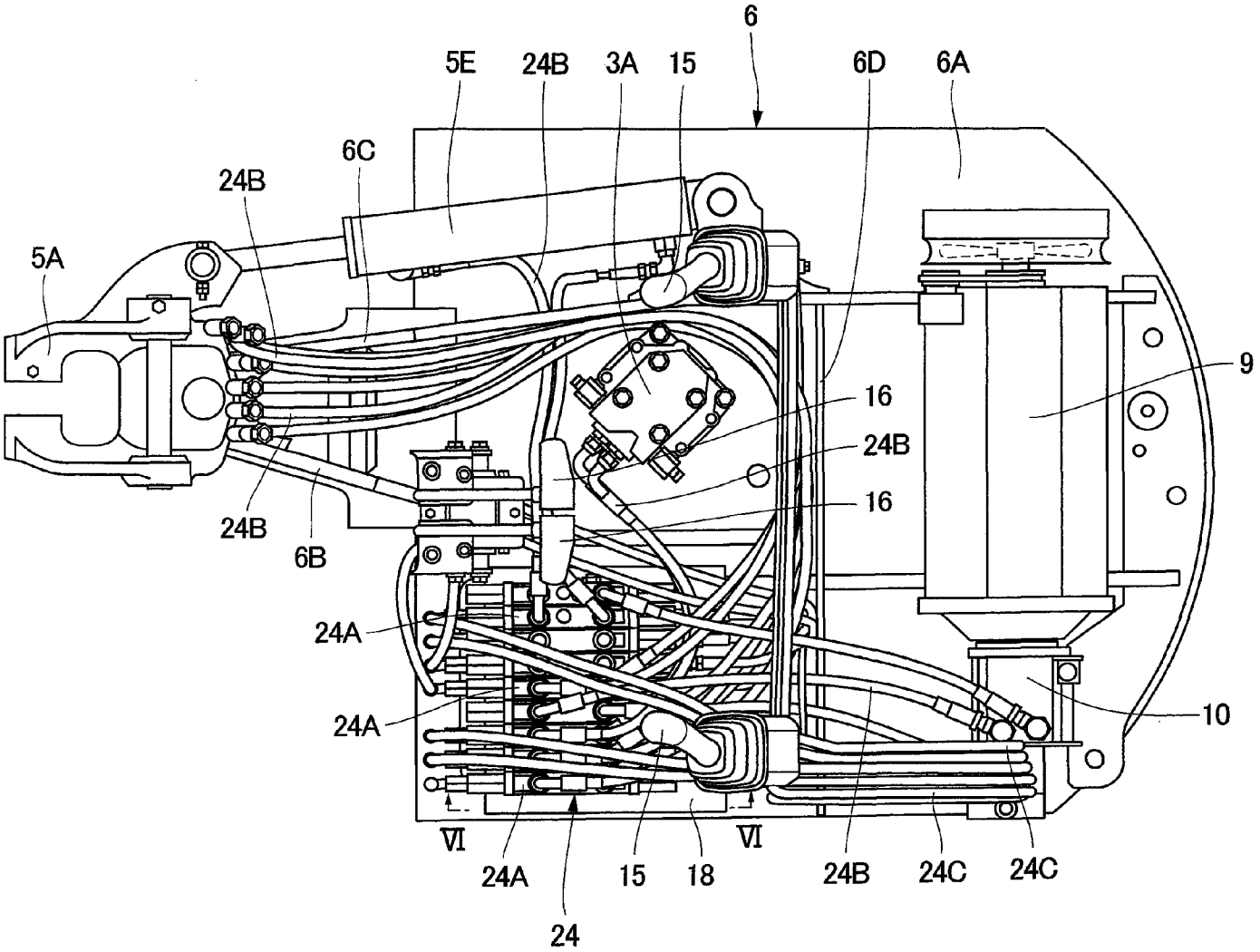
FIG. 2 is a plan view showing a state in which an engine, a hydraulic pump, a control valve block, an operation lever, a hydraulic hose and the like are arranged on a revolving frame.
Figure 3:
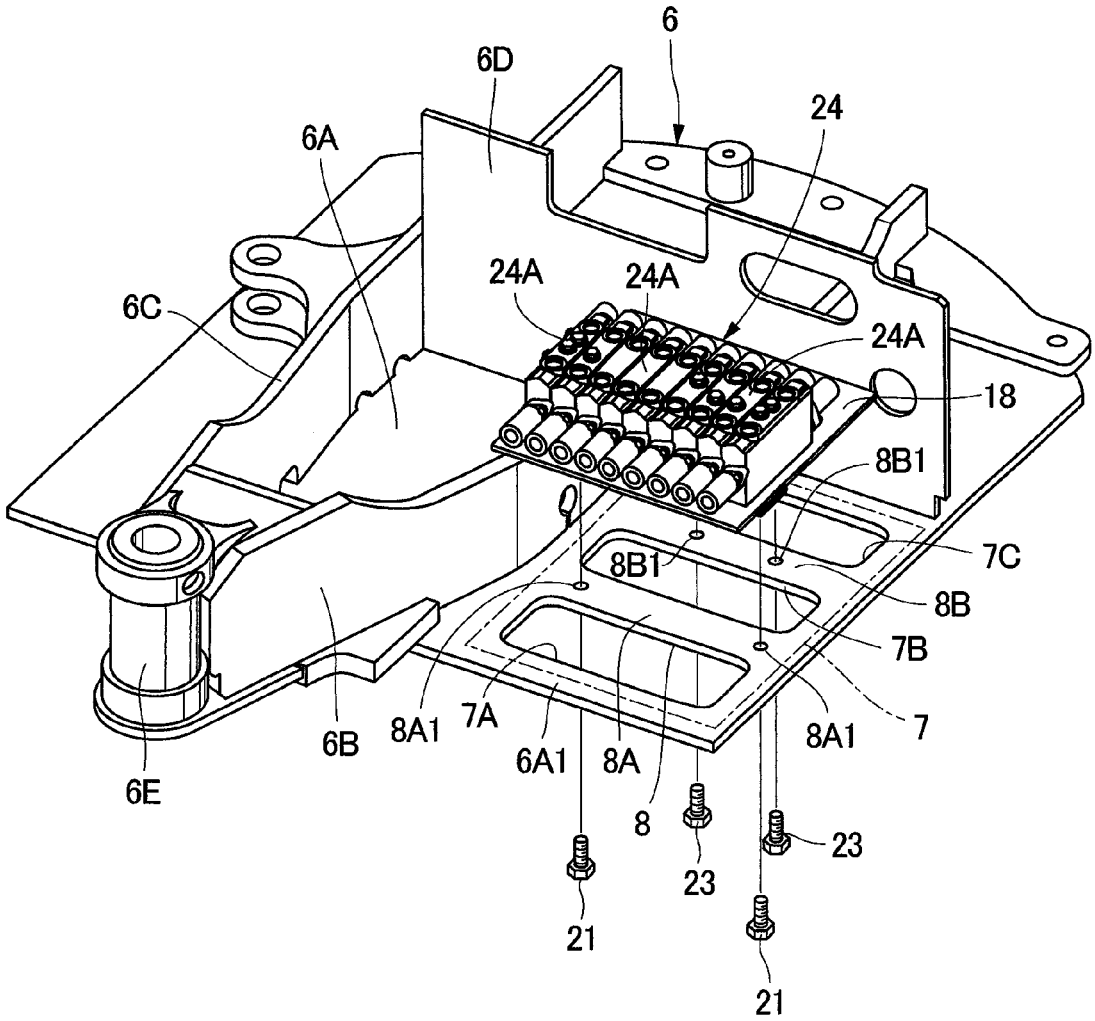
FIG. 3 is an exploded perspective view showing the revolving frame, a control valve block, a control valve block mounting plate and the like according to a first embodiment.

The revolving frame 6 forms a base of the upper revolving structure 4, and the revolving frame 6 forms a firm support structural body. As shown in FIGS. 2 and 3, the revolving frame 6 is composed of a bottom plate 6A formed having a rectangular flat plate shape extending in the front-rear direction by using a thick steel plate material, a left vertical plate 63 and a right vertical plate 6C installed upright on an upper surface side of the bottom plate 6A, faced in the left-right direction, and extending in the front-rear direction, a lateral plate 6D installed upright in an intermediate portion in the front-rear direction of the bottom plate 6A and extending in the left-right direction from the right vertical plate 6C beyond the left vertical plate 6B to the vicinity of a left end portion of the bottom plate 6A, and a weight-reducing part 7 which will be described later.

Here, the left and right vertical plates 6B and 6C are arranged in the V-shape when seen from above so that an interval in the left-right direction is gradually reduced from a rear end portion to a front end portion. A swing bracket 6E having a cylindrical shape supporting the swing post 5A of the front device 5 is provided on the front end sides of the left and right vertical plates 6B and 6C. Moreover, the lateral plate 6D reinforces the left and right vertical plates 6B and 6C by connecting them to each other and also partitions the engine 9 which will be described later from the control valve block 24.

The weight-reducing part 7 is provided on the bottom plate 6A of the revolving frame 6, and the weight-reducing part 7 reduces the weight of the bottom plate 6A. Here, the weight-reducing part 7 is provided in a range on a front side of a left front corner portion 6A1 partitioned by the left vertical plate 6B and the lateral plate 6D in the bottom plate 6A, that is, on a left side of the left vertical plate 6B and on a front side of the lateral plate 6D.

The weight-reducing part 7 is composed of three through holes 7A, 7B, and 7C each having a laterally elongated rectangular shape penetrating the bottom plate 6A in a vertical direction and extending in the left-right direction, and each of these through holes 7A to 7C is arranged at intervals in the front-rear direction. As a result, the weight of the bottom plate 6A can be reduced by forming the three through holes 7A, 7B, and 7C on the bottom plate 6A made of the thick steel plate material.

A support beam 8 is formed by being located among the through holes 7A, 7B, and 7C on the left front corner portion 6A1 of the bottom plate 6A. This support beam 8 is a component on which left and right support members 19 and 20 which will be described later are mounted. Here, the support beam 8 is composed of a front support beam 8A extending in the left-right direction between the through holes 7A and 7B and a rear support beam 8B extending in the left-right direction between the through holes 7B and 7C. Two bolt insertion holes 8A1 penetrating in the vertical direction are drilled on the front support beam 8A away from each other in the left-right direction. Two bolt insertion holes 8B1 penetrating in the vertical direction are drilled also in a rear support beam 8B away from each other in the left-right direction.

Here, a relationship between the weight-reducing part 7 and the support beam 8 will be described. The front support beam 8A and the rear support beam 8B are arranged in a state surrounded by the weight-reducing part 7 made of the three through holes 7A, 7B, and 7C provided in the front-rear direction. That is, the weight-reducing part 7 is provided on a portion excluding the front support beam 8A and the rear support beam 8B. Therefore, the weight-reducing part 7 does not hinder when the support members 19 and 20 which will be described later are mounted on the front support beam 8A and the rear support beam 8B.

The engine 9 is mounted on a rear side of the revolving frame 6 and the engine 9 is used as a prime mover. The engine 9 is arranged in a laterally placed state with a crank shaft (not shown) extending in the left-right direction. A hydraulic pump 10 is mounted on the left end side of the engine 9, and the hydraulic pump 10 is driven by the engine 9. The hydraulic pump 10 discharges the pressurized oil for operation toward the traveling motor 2E of the lower traveling structure 2, the revolving motor 3A of the revolving device 3, the actuators such as each of the cylinders 5E, 5F, 5G, 5H and the like of the front device 5.

The counterweight 11 is provided on the rear end side of the revolving frame 6, and the counterweight 11 takes a weight balance with the front device 5. Here, the counterweight 11 is formed as a heavy article with a center part in the left-right direction protruding rearward and curved having an arc shape so as to cover the engine 9, the hydraulic pump 10 and the like from the rear side. On the other hand, the counterweight 11 becomes a base member on the revolving frame 6 side for mounting the canopy 17 which will be described later.

An operator's seat mounting base 12 is provided on the revolving frame 6 so as to cover an upper front side of the engine 9. The operator's seat 14 which will be described later is mounted on the operator's seat mounting base 12. A floor plate 13 is provided on a front side of the operator's seat mounting base 12. The floor plate 13 forms a stephold for an operator seated on the operator's seat 14.

The operator's seat 14 is provided on the operator's seat mounting base 12, and the operator's seat 14 is a seat on which the operator is seated. Left and right working control levers 15 for operating the front device 5 and the revolving device 3 are disposed on both left and right sides of the operator's seat 14. Left and right traveling control levers 16 for operating the traveling motor 2E of the lower traveling structure 2 are disposed on a front side of the operator's seat 14. The working control levers 15 and the traveling control levers 16 are formed of a pressure-reducing valve type hydraulic pilot valve. A pilot pressure is supplied to the control valve block 24 which will be described later in accordance with an operation to the working control levers 15 and the traveling control levers 16.

A double-columnar type canopy 17 is provided on the upper revolving structure 4. This canopy 17 is composed of left and right columns 17A mounted on an upper surface of the counterweight 11 and extending in the vertical direction and a roof 17B mounted on an upper end side of each of the columns 17A and covers the operator's seat 14 from above.

Subsequently, the control valve block mounting plate and the control valve block used in the first embodiment will be explained.

The control valve block mounting plate 18 is provided on the bottom plate 6A of the revolving frame 6. The control valve block 24 which will be described later is mounted on this control valve block mounting plate 18. Here, as shown in FIGS. 3 to 6, the control valve block mounting plate 18 is formed having a square flat plate shape by using a steel plate material thinner than the bottom plate 6A. In the control valve block mounting plate 18, four bolt insertion holes 18A penetrating in the vertical direction (plate thickness direction) are drilled at intervals from each other in the front-rear direction and the left-right direction. The left and right support members 19 and 20 which will be described later are provided on a back surface 18B faced with the bottom plate 6A of the revolving frame 6 in the control valve block mounting plate 18. The control valve block 24 which will be described later is mounted on an upper surface 18C on the side opposite to the back surface 18B of the control valve block mounting plate 18.

The left support member 19 and the right support member 20 are provided on the back surface 18B of the control valve block mounting plate 18 away from each other in the left-right direction. The left support member 19 and the right support member 20 support the control valve block mounting plate 18 at positions (positions higher than the bottom plate 6A) away to the above from the bottom plate 6A of the revolving frame 6.

Here, the left support member 19 is formed as a frame body having a U-shaped section by bending a steel plate material or the like with an upper side as an open end 19A and a lower side as a mounting surface 19B. A bolt insertion hole 19C is drilled in a center part of the mounting surface 19B. A nut 19D is welded on a surface of the mounting surface 19B faced with the control valve block mounting plate 18 concentrically with the bolt insertion hole 19C (see FIG. 6). On the other hand, the right support member 20 is also formed as a frame body having a U-shaped section having an open end 20A and a mounting surface 20B similarly to the left support member 19. In the mounting surface 20B, a bolt insertion hole 20C is drilled, and a nut 20D is welded concentrically with the bolt insertion hole 20C.

Figure 7:
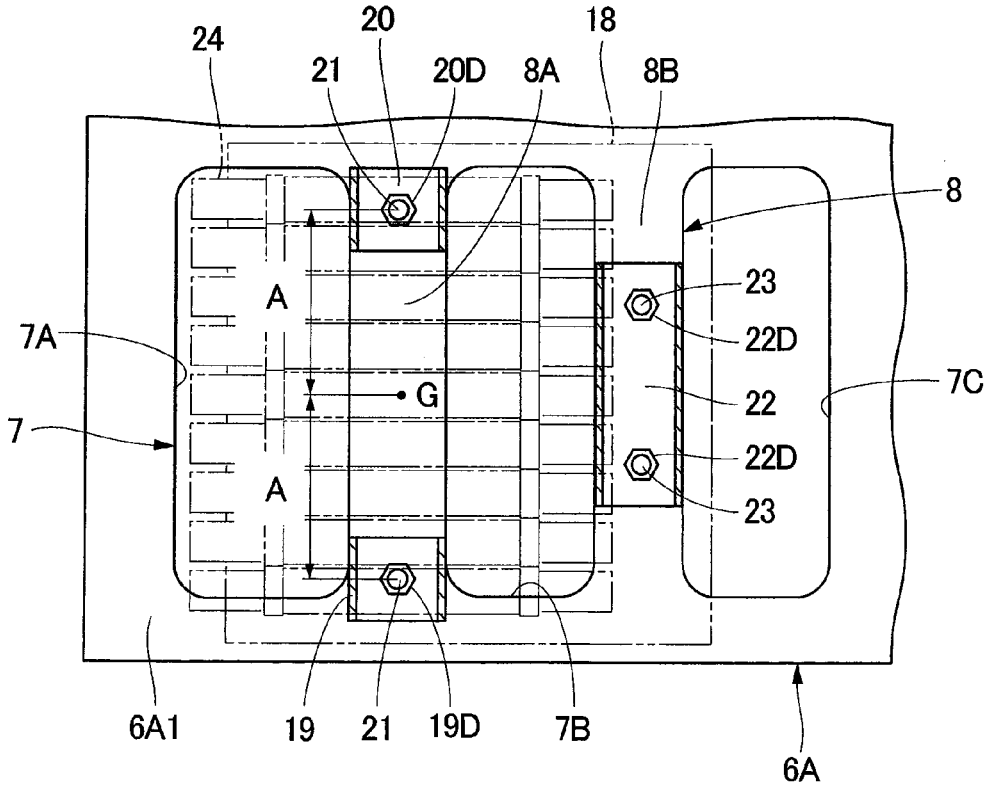
FIG. 7 is a sectional view of an arrangement relationship between a center position of gravity of the control valve block and each of the support members seen from an arrow VII-VII direction in FIG. 6.
Figure 8:
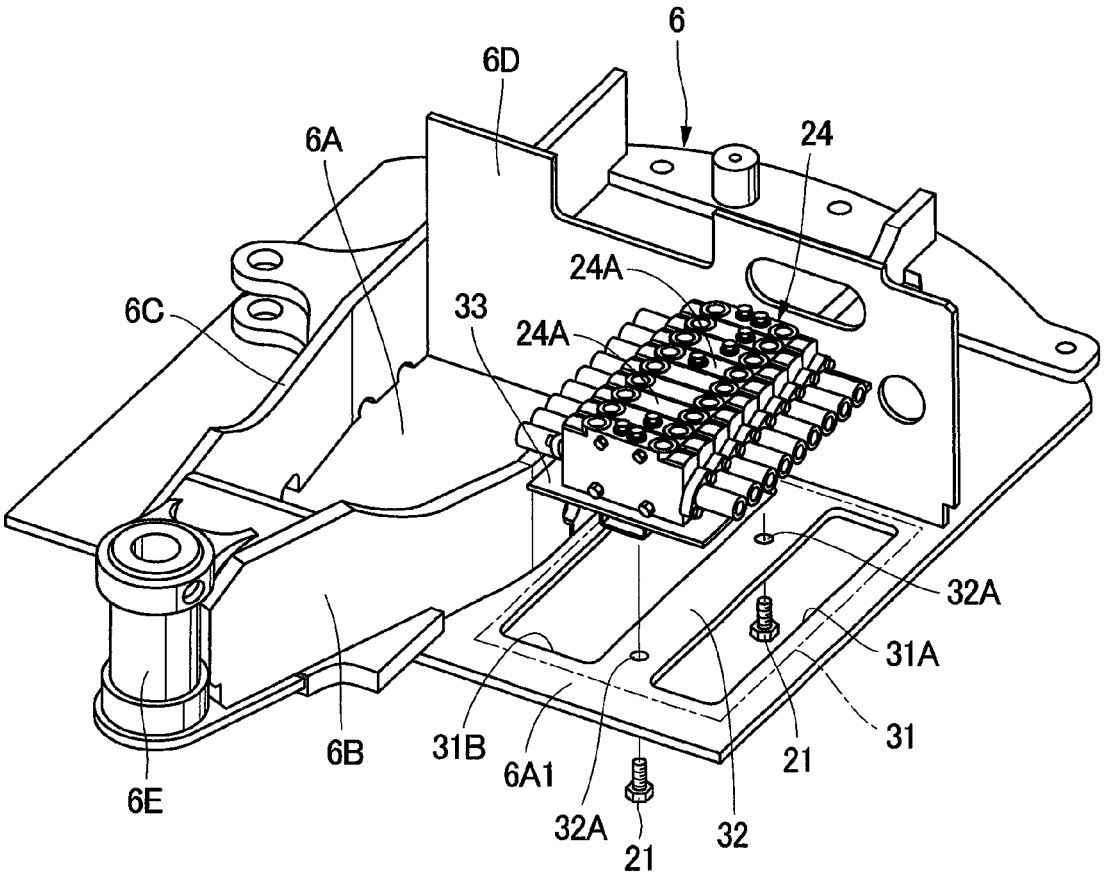
FIG. 8 is an exploded perspective view showing the revolving frame, the control valve block, the control valve block mounting plate and the like according to a second embodiment.
Figure 9:
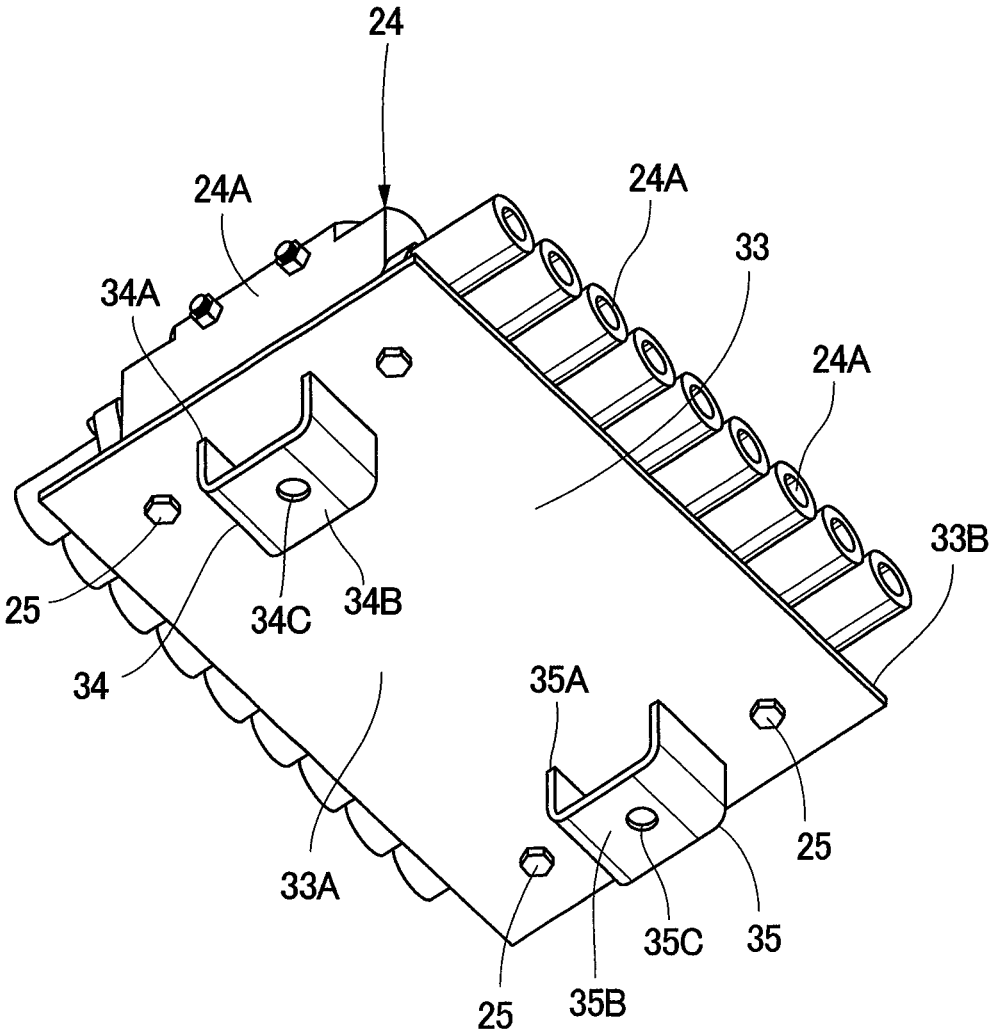
FIG. 9 is a perspective view of the control valve block mounting plate, the control valve block, and the support member seen from the back surface side of the control valve block mounting plate.
Figure 10:
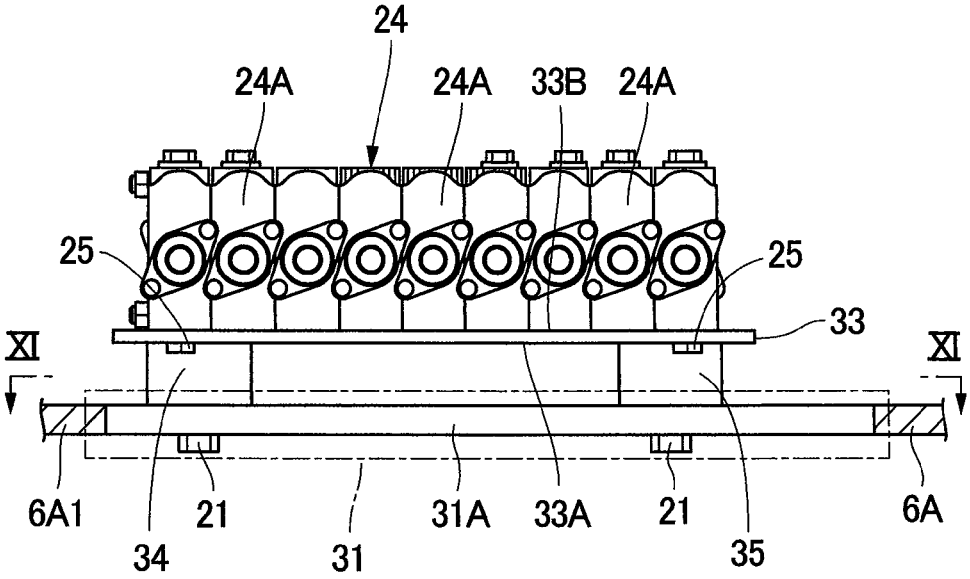
FIG. 10 is a sectional view of the through hole of the bottom plate, the control valve block mounting plate, the control valve block and the support member seen from a position similar to FIG. 6.

The left support member 19 and the right support member 20 are arranged at an interval in the left-right direction on the back surface 18B side of the control valve block mounting plate 18. The open end 19A of the left support member 19 and the open end 20A of the right support member 20 are fixed to the back surface 18B of the control valve block mounting plate 18, respectively, by using means such as welding or the like. As shown in FIGS. 3 and 7, a bolt 21 is inserted upward into each of the bolt insertion holes 8A1 of the front support beam 8A provided on the left front corner portion 6A1 of the bottom plate 6A, and this bolt 21 is screwed with a nut 19D of the left support member 19 and a nut 20D of the right support member 20, respectively. As a result, the control valve block mounting plate 18 is mounted on the front support beam 8A of the bottom plate 6A through the left and right support members 19 and 20.

In this case, as shown in FIG. 7, assuming that the center position of gravity of the control valve block 24 mounted on the control valve block mounting plate 18 is G, a distance A between the center of the bolt 21 screwed with the nut 19D of the left support member 19 and the center position of gravity G of the control valve block 24 and the distance A between the center of the bolt 21 screwed with the nut 20D of the right support member 20 and the center position of gravity G of the control valve block 24 are set equal. That is, the left support member 19 and the right support member 20 are fixed to the back surface 18B of the control valve block mounting plate 18 at positions having the equal distances A sandwiching the center position of gravity G of the control valve block 24. On the other hand, the left support member 19 and the right support member 20 fixed to the control valve block mounting plate 18 are mounted on the front support beam 8A provided on the bottom plate 6A of the revolving frame 6 at the positions immediately below the center position of gravity G of the control valve block 24 by using the bolt 21. It should be noted that the center position of gravity G is present at a specific position (position which becomes the center of gravity) in the control valve block 24, but the center position of gravity G is schematically shown in FIGS. 6 and 7.

An auxiliary bracket 22 is provided on the back surface 18B of the control valve block mounting plate 18 on the rear side away from the left and right support members 19 and 20. This auxiliary bracket 22 is mounted on the rear support beam 8B formed on the bottom plate 6A of the revolving frame 6. Here, the auxiliary bracket 22 is formed as a frame body having a U-shaped section which is more lengthy in the left-right direction than the left and right support members 19 and 20. An upper side of the auxiliary bracket 22 becomes an open end 22A, while a lower side of the auxiliary bracket 22 becomes amounting surface 22B. Two bolt insertion holes 22C are drilled in the mounting surface 22B away from each other in the left-right direction, and on the surface of the mounting surface 22B faced with the control valve block mounting plate 18, two nuts 22D are fixed concentrically with each of the bolt insertion holes 22C.

Figure 6:
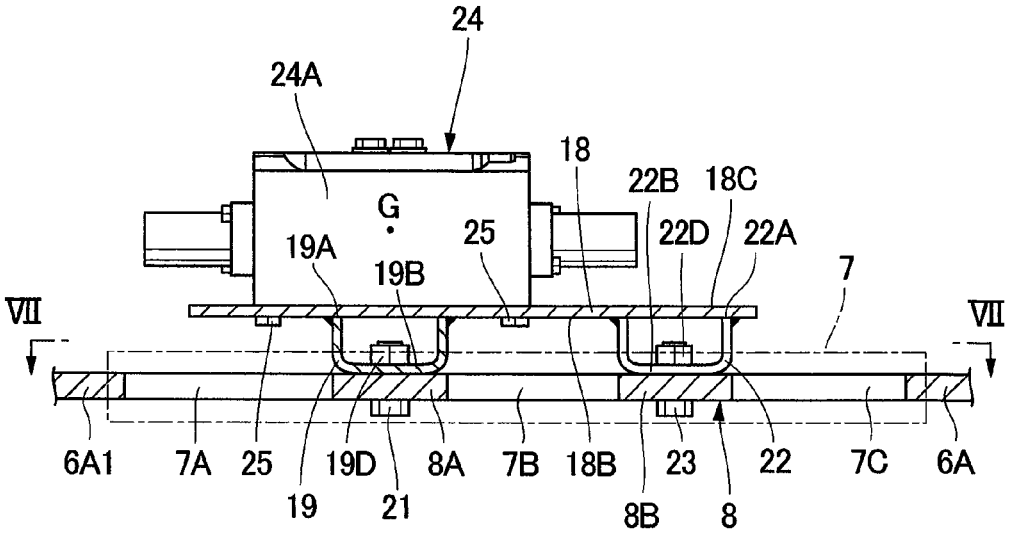
FIG. 6 is a sectional view of a through hole and a support beam of the bottom plate, the control valve block mounting plate, the control valve block, and the support member seen from an arrow VI-VI direction in FIG. 2.

As shown in FIGS. 3 and 6, a bolt 23 is inserted upward into each of the bolt insertion holes 8B1 of the rear support beam 8B provided on the left front corner portion 6A1 of the bottom plate 6A, and this bolt 23 is screwed with each of the nuts 22D of the auxiliary bracket 22. As a result, the control valve block mounting plate 18 is mounted on the rear support beam 8B of the bottom plate 6A through the auxiliary bracket 22. Therefore, the control valve block mounting plate 18 is made more stable by the auxiliary bracket 22 in addition to stable support by the left and right support members 19 and 20.

The control valve block 24 is mounted on the upper surface 18C of the control valve block mounting plate 18. This control valve block 24 is arranged on the left front corner portion 6A1 of the bottom plate 6A constituting the revolving frame 6 through the control valve block mounting plate 18. The control valve block 24 is made of a collective body of a plurality of directional control valves 24A. Each of the directional control valves 24A controls supply/discharge of the pressurized oil to the traveling motor 2E of the lower traveling structure 2, the revolving motor 3A of the revolving device 3, and each of the cylinders 5E, 5F, 5G, and 5H of the front device 5.

Hydraulic lines 24B through which the pressurized oil to be supplied to each of the actuators from the hydraulic pump 10 and return oil returning to the tank (not shown) from each of the actuators flow are connected to each of the directional control valves 24A constituting the control valve block 24, respectively. On the other hand, a pilot line 24C through which a pilot pressure according to an operation of the working control lever 15 and the traveling control lever 16 is supplied is connected to each of the directional control valves 24A, respectively. Therefore, each of the directional control valves 24A controls a direction of the pressurized oil to be supplied to/discharged from each of the actuators on the basis of the pilot pressure supplied through the pilot line 24C. As a result, the desired actuator can be operated.

Figure 4:
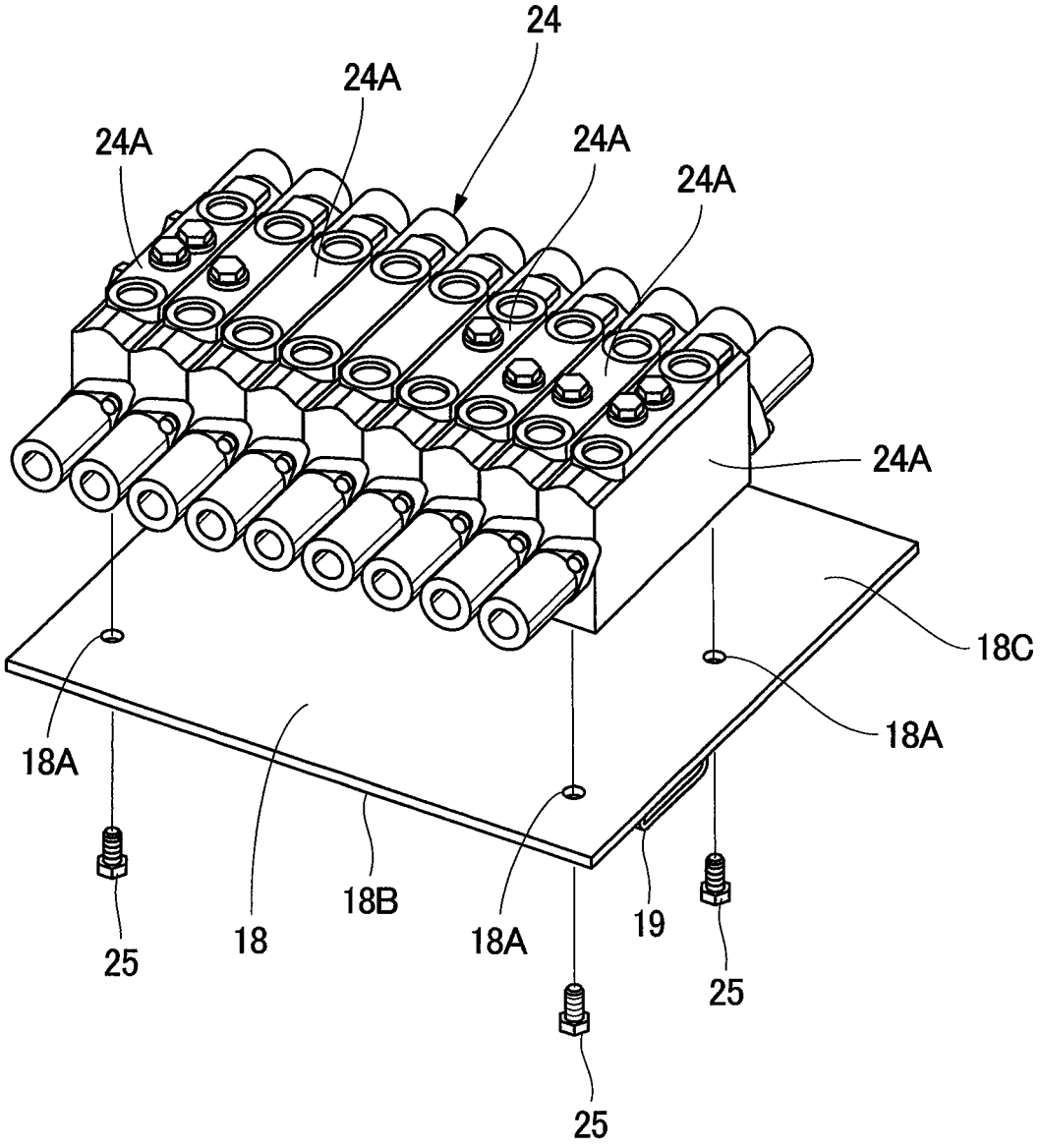
FIG. 4 is an exploded perspective view showing a state in which the control valve block is removed from the control valve block mounting plate.
Figure 5:
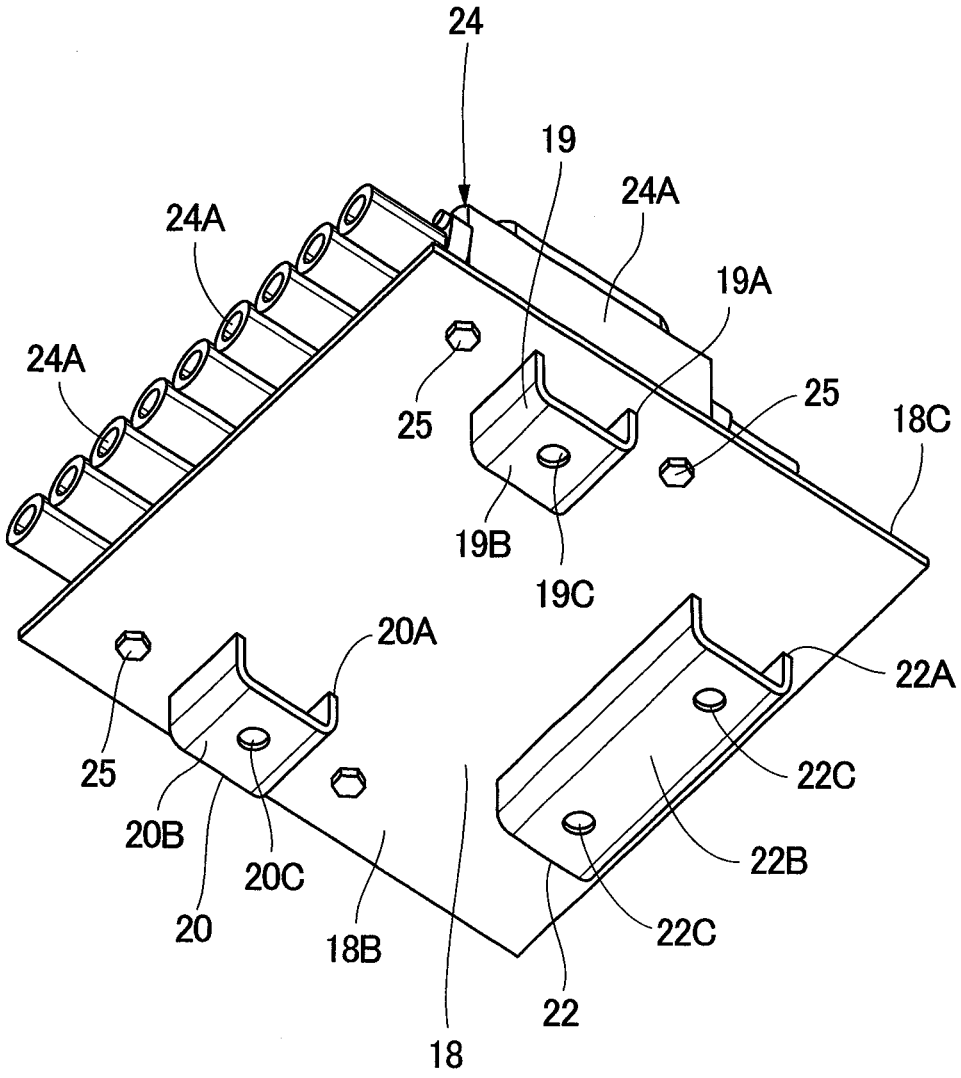
FIG. 5 is a perspective view of the control valve block mounting plate, the control valve block, and a support member seen from a back surface side of the control valve block mounting plate.

These plural directional control valves 24A are united by using a plurality of lengthy bolts or the like (not shown) in a state juxtaposed in the left-right direction so as to form the control valve block 24 made of a single block body. As shown in FIG. 4, a bolt 25 inserted upward into each of the bolt insertion holes 18A of the control valve block mounting plate 18 is screwed into the lower surface side of the control valve block 24. As a result, the plurality of directional control valves 24A are collectively mounted on the upper surface 18C side of the control valve block mounting plate 18 so as to constitute the control valve block 24. In this case, each of the directional control valves 24A constituting the control valve block 24 is formed of a robust metal block body so that the directional control valves 24A can withstand the high-pressure pressurized oil discharged from the hydraulic pump 10. Thus, the control valve block 24 made of a collective body of the plurality of directional control valves 24A is a heavy article having a large weight.

The hydraulic excavator 1 according to the first embodiment has the above described configuration, and its operation will be explained. When the operator seated on the operator's seat 14 operates the traveling control lever 16, the directional control valve 24A constituting the control valve block 24 controls supply/discharge of the pressurized oil to the traveling motor 2E of the lower traveling structure 2. As a result, the lower traveling structure 2 is allowed to travel. On the other hand, when the operator operates the working control lever 15, the other directional control valve 24A constituting the control valve block 24 controls supply/discharge of the pressurized oil to the revolving motor 3A of the revolving device 3, each of the cylinders 5E, 5F, 5G, 5H and the like of the front device 5. As a result, the revolving device 3 or the front device 5 can be operated to perform an excavating work of earth and sand and the like.

Subsequently, a procedure for mounting the control valve block 24 used in the first embodiment on the bottom plate 6A of the revolving frame 6 through the control valve block mounting plate 18 will be explained.

As shown in FIG. 4, the plurality of directional control valves 24A are united by using the plurality of lengthy bolts or the like (not shown) in the state juxtaposed in the left-right direction so as to form the control valve block 24 made of one block body. Subsequently, the bolt 25 is inserted upward from the back surface 18B side to each of the bolt insertion holes 18A of the control valve block mounting plate 18, and this bolt 25 is screwed into the lower surface side of the control valve block mounting plate 18. As a result, the control valve block 24 integrated by uniting the plurality of directional control valves 24A can be mounted on the upper surface 18C of the control valve block mounting plate 18.

The left and right support members 19 and 20 provided on the back surface 18B of the control valve block mounting plate 18 are placed on the front support beam 8A provided on the left front corner portion 6A1 of the bottom plate 6A constituting the revolving frame 6. In this state, the bolt 21 is inserted upward from the back surface side of the bottom plate 6A to each of the bolt insertion holes 8A1 provided on the front support beam 8A, and this bolt 21 is screwed with the nut 19D of the left support member 19 and the nut 20D of the right support member 20, respectively. As a result, the control valve block mounting plate 18 can be mounted on the front support beam 8A of the bottom plate 6A through the left and right support members 19 and 20.

On the other hand, the auxiliary bracket 22 provided on the back surface 18B of the control valve block mounting plate 18 on the rear side away from the left and right support members 19 and 20 is placed on the rear support beam 8B provided on the bottom plate 6A of the revolving frame 6 on the rear side away from the front support beam 8A. In this state, the bolt 23 is inserted upward from the back surface side of the bottom plate 6A into each of the bolt insertion holes 8B1 provided on the rear support beam 8B, and this bolt 23 is screwed with the nut 22D of the auxiliary bracket 22. As a result, the control valve block mounting plate 18 can be mounted on the rear support beam 8B of the bottom plate 6A through the auxiliary bracket 22.

In this case, as shown in FIG. 7, the separated distance A in the left-right direction between the center of the bolt 21 screwed with the nut 19D of the left support member 19 and the center position of gravity G of the control valve block 24 mounted on the control valve block mounting plate 18 and the separated distance A in the left-right direction between the center of the bolt 21 screwed with the nut 20D of the right support member 20 and the center position of gravity G of the control valve block 24 are set equal. That is, the left support member 19 and the right support member 20 are fixed to the back surface 18B of the control valve block mounting plate 18 at the positions having the equal distance A in the left-right direction sandwiching the center position of gravity G of the control valve block 24. Moreover, as shown in FIG. 6, the left support member 19 and the right support member 20 fixed to the control valve block mounting plate 18 are mounted on the front support beam 8A provided on the bottom plate 6A of the revolving frame 6 by using the bolt 21 at the positions immediately below the center position of gravity G of the control valve block 24.

Thus, according to the first embodiment, the left support member 19 and the right support member 20 are provided at two spots having equal distances sandwiching the center position of gravity G of the control valve block 24 in the back surface 18B of the control valve block mounting plate 18, and the left and right support members 19 and 20 are configured to be mounted on the front support beam 8A of the revolving frame 6 (bottom plate 6A) with high strength. As a result, the control valve block 24 which is a heavy article can be stably supported on the bottom plate 6A at the two spots sandwiching its center position of gravity G.

Moreover, at a portion away from the front support beam 8A on which the left and right support members 19 and 20 of the control valve block mounting plate 18 are mounted and the rear support beam 8B on which the auxiliary bracket 22 of the control valve block mounting plate 18 is mounted in the bottom plate 6A of the revolving frame 6, the weight-reducing part 7 composed of the three through holes 7A, 7B, and 7C is provided. Thus, the weight of the revolving frame 6 can be reduced, and weight reduction of the entire hydraulic excavator 1 can be promoted.

As described above, among each of the through holes 7A, 7B, and 7C, the front support beam 8A and the rear support beam 8B having sufficient strength are formed. Thus, by mounting each of the support members 19 and 20 provided on the control valve block mounting plate 18 on the front support beam 8A, the control valve block 24 which is a heavy article can be supported with sufficient strength also with respect to the revolving frame 6 whose weight is reduced by the weight-reducing part 7.

On the other hand, the left and right support members 19 and 20 of the control valve block mounting plate 18 are arranged at the positions having the equal distances A sandwiching the center position of gravity G of the control valve block 24. As a result, the control valve block 24 is stably supported with respect to the bottom plate 6A through the two support members 19 and 20. As a result, the numbers of the support members 19 and 20 can be reduced to the minimum, and the weight of the entire hydraulic excavator 1 can be further reduced.

Moreover, the control valve block 24 can be arranged at the position higher than the bottom plate 6A by the left and right support members 19 and 20 provided on the control valve block mounting plate 18. As a result, workability when the hydraulic line 24B and the pilot line 24C are connected to each of the directional control valves 24A constituting the control valve block 24, for example, can be improved.

Furthermore, the left front corner portion 6A1 of the bottom plate 6A on which the support beam 8 composed of the front support beam 8A and the rear support beam 8B and the weight-reducing part 7 composed of the through holes 7A, 7B, and 7C are provided is reinforced by the left vertical plate 6B and the lateral plate 6D installed upright on the bottom plate 6A. As a result, strength of the support beam 8 can be further improved, and the control valve block 24 which is a heavy article can be supported more stably.

FIGS. 8 to 11 show a second embodiment of the present invention. A feature of the second embodiment is that the weight-reducing part composed of a vertically long rectangular through hole extending in the front-rear direction is configured to be provided on the bottom plate of the revolving frame. In this embodiment, component elements that are identical to those in the foregoing first embodiment will be simply denoted by the same reference numerals to avoid repetitions of similar explanations.

A weight-reducing part 31 according to the second embodiment is provided on the bottom plate 6A of the revolving frame 6. This weight-reducing part 31 is provided on the left front corner portion 6A1 partitioned by the left vertical plate 6B and the lateral plate 6D in the bottom plate 6A constituting the revolving frame 6 similarly to the weight-reducing part 7 according to the first embodiment. However, the weight-reducing part 31 according to the second embodiment is different from the weight-reducing part 7 according to the first embodiment in the shapes and the numbers of through holes 31A and 31B which will be described later.

Here, the weight-reducing part 31 is composed of the two through holes 31A and 31B each penetrating the bottom plate 6A in the vertical direction and having a vertically long rectangular shape extending in the front-rear direction. Each of these through holes 31A and 31B is juxtaposed at an interval in the left-right direction. As described above, by forming the two through holes 31A and 31B on the bottom plate 6A made of a thick steel plate material, the weight of the revolving frame 6 can be reduced.

A support beam 32 is located between each of the through holes 31A and 31B and formed on the left front corner portion 6A1 of the bottom plate 6A. This support beam 32 extends between each of the through holes 31A and 31B in the front-rear direction and is a component on which front and rear support members 34 and 35 which will be described later are mounted. On the support beam 32, two bolt insertion holes 32A penetrating in the vertical direction are drilled away from each other in the front-rear direction.

A control valve block mounting plate 33 is a component on which the control valve block 24 is mounted. This control valve block mounting plate 33 is formed having a rectangular flat plate shape extending in the front-rear direction by using a steel plate material thinner than the bottom plate 6A. The front and rear support members 34 and 35 which will be described later are provided on a back surface 33A faced with the bottom plate 6A of the revolving frame 6 in the control valve block mounting plate 33. The control valve block 24 is mounted on an upper surface 33B which is a side opposite to the back surface 33A in the control valve block mounting plate 33 by using the bolt 25.

The front support member 34 and the rear support member 35 are provided on the back surface 33A of the control valve block mounting plate 33 away from each other in the front-rear direction. The front support member 34 and the rear support member 35 support the control valve block mounting plate 33 at a position (position higher than the bottom plate 6A) away to the above from the bottom plate 6A of the revolving frame 6.

Here, the front support member 34 is formed as a frame body having a U-shaped section with an upper side as an open end 34A and a lower side as amounting surface 34B. A bolt insertion hole 34C is drilled in a center part of the mounting surface 34B and a nut 34D is welded concentrically with the bolt insertion hole 34C on a surface of the mounting surface 34B faced with the control valve block mounting plate 33. On the other hand, the rear support member 35 is also formed as a frame body having a U-shaped section having an open end 35A and a mounting surface 35B similarly to the front support member 34. In the mounting surface 35B of the rear support member 35, a bolt insertion hole 35C is drilled, and a nut 35D is welded concentrically with the bolt insertion hole 35C.

The open end 34A of the front support member 34 and the open end 35A of the rear support member 35 are fixed to the back surface 18B of the control valve block mounting plate 33, respectively, by using means such as welding or the like. The bolt 21 is inserted upward into each of the bolt insertion holes 32A of the support beam 32 provided on the left front corner portion 6A1 of the bottom plate 6A, and this bolt 21 is screwed with the nut 34D of the front support member 34 and the nut 35D of the rear support member 35, respectively. As a result, the control valve block mounting plate 33 is mounted on the support beam 32 of the bottom plate 6A through the front and rear support members 34 and 35.

Figure 11:
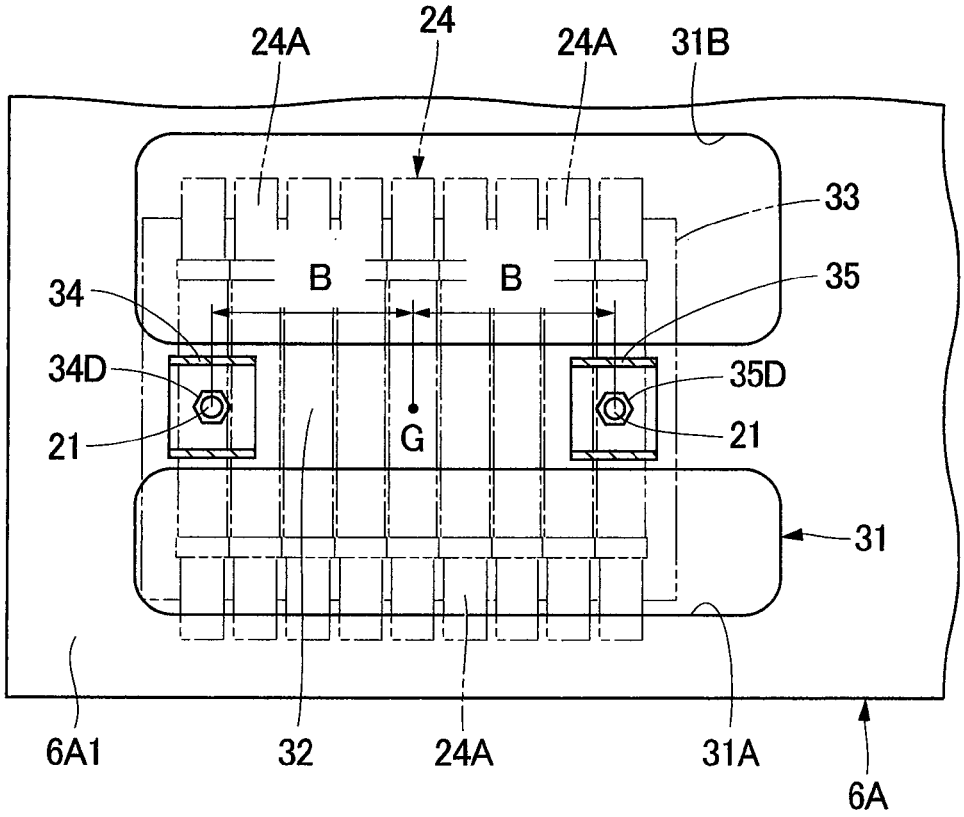
FIG. 11 is a sectional view of an arrangement relationship between the center position of gravity of the control valve block and each of the support members seen from an arrow XI-XI direction in FIG. 10.

In this case, as shown in FIG. 11, assuming that the center position of gravity of the control valve block 24 mounted on the control valve block mounting plate 33 is G, a separation distance B in the front-rear direction between the center of the bolt 21 screwed with the nut 34D of the front support member 34 and the center position of gravity G of the control valve block 24 and the separation distance B in the front-rear direction between the center of the bolt 21 screwed with the nut 35D of the rear support member 35 and the center position of gravity G of the control valve block 24 are set equal. That is, the front support member 34 and the rear support member 35 are fixed to the back surface 33A of the control valve block mounting plate 33 at positions having the equal distances B in the front-rear direction sandwiching the center position of gravity G of the control valve block 24. Moreover, the front support member 34 and the rear support member 35 fixed to the control valve block mounting plate 33 are mounted on the support beam 32 provided on the bottom plate 6A of the revolving frame 6 at the positions immediately below the center position of gravity G of the control valve block 24 by using the bolt 21.

The hydraulic excavator according to the second embodiment has the weight-reducing part 31 as described above provided on the revolving frame 6. In the second embodiment, too, the control valve block 24 mounted on the control valve block mounting plate 33 can be mounted on the support beam 32 of the revolving frame 6 (bottom plate 6A) with high strength at the two spots sandwiching its center position of gravity G, and the control valve block 24 which is a heavy article can be stably supported on the bottom plate 6A.

Moreover, at a position in the bottom plate 6A of the revolving frame 6 away from the support beam 32 on which the front and rear support members 34 and 35 of the control valve block mounting plate 33, are mounted, the weight-reducing part 31 composed of the two through holes 31A and 31B is provided. Thus, the weight of the revolving frame 6 can be reduced, and weight reduction of the entire hydraulic excavator 1 can be promoted.

Figure 12:
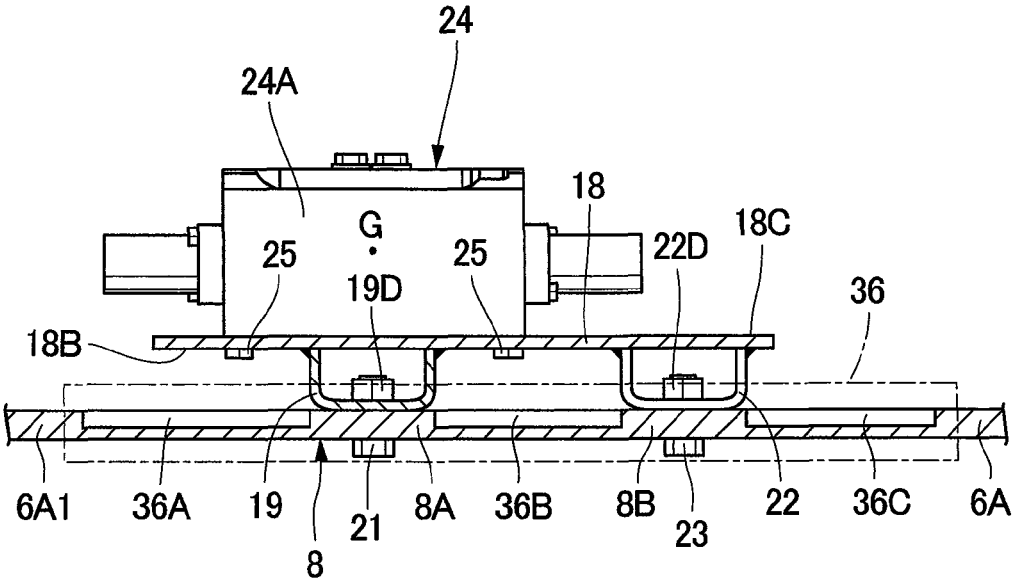
FIG. 12 is a sectional view of the weight-reducing part according to a first variation of the present invention seen from the position similar to FIG. 6.

It should be noted that in the above described first embodiment, the case in which the weight-reducing part 7 provided on the bottom plate 6A of the revolving frame 6 is composed of the three through holes 7A, 7B, and 7C penetrating in the vertical direction is exemplified. However, the present invention is not limited to this and it may be configured as in a first variation shown in FIG. 12, for example. That is, a weight-reducing part 36 composed of three recessed grooves 36A, 36B, and 36C may be formed by recessing the upper surface of the bottom plate 6A by using means such as milling as shown in FIG. 12. In this case, strength of the bottom plate 6A can be improved as compared with the configuration in which the weight-reducing part 7 composed of the three through holes 7A, 7B, and 7C is provided. This also applies to the weight-reducing part 31 according to the second embodiment.

Figure 13:
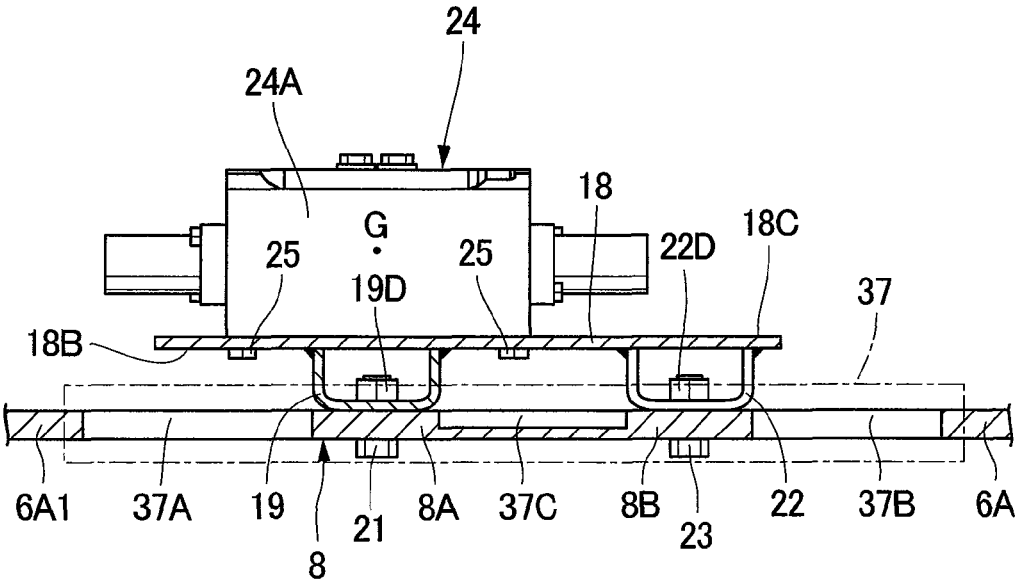
FIG. 13 is a sectional view of the weight-reducing part according to a second variation of the present invention seen from the position similar to FIG. 6.

In addition, as in a second variation shown in FIG. 13, for example, such configuration may be employed that a weight-reducing part 37 composed of two through holes 37A and 37B and one recessed groove 37C is provided on the bottom plate 6A. This also applies to the weight-reducing part 31 according to the second embodiment.

In the above described first embodiment, the case in which the weight-reducing part 7 is composed of the three through holes 7A to 7C is exemplified. However, the present invention is not limited to that, and the weight-reducing part may be configured by one through hole or recessed groove or the weight-reducing part may be configured by four or more through holes and/or is recessed grooves.

In each of the embodiments, the hydraulic excavator 1 with a canopy specification provided with the canopy 17 covering the upper part of the operator's seat 14 is exemplified. However, the present invention is not limited to that and may be applied to a hydraulic excavator with a cab specification provided with a cab box covering a periphery and an upper part of the operator's seat 14.

Moreover, in each of the embodiments, the hydraulic excavator 1 provided with the crawler-type lower traveling structure 2 is explained as an example of a construction machine. However, the present invention is not limited to that and may be applied to a hydraulic excavator provided with a wheel-type lower traveling structure, for example, and the like.

DESCRIPTION OF REFERENCE NUMERALS

1: Hydraulic excavator (Construction machine)
2: Lower traveling structure
2E: Traveling motor
4: Upper revolving structure
5: Front device
5E: Swing cylinder
5F: Boom cylinder
5G: Arm cylinder
5H: Bucket cylinder
6: Revolving frame
6A: Bottom plate
6B: Left vertical plate
6C: Right vertical plate
6D: Lateral plate
7, 31, 36, 37: Weight-reducing part
7A, 7B, 7C, 31A, 31B, 37A, 37B: Through hole
8, 32: Support beam
9: Engine (Prime mover)
10: Hydraulic pump
18, 33: Control valve block mounting plate
18B, 33A: Back surface
19: Left support member
20: Right support member
24: Control valve block
24A: Directional control valve
34: Front support member
35: Rear support member
36A, 36B, 36C: Recessed groove

The invention claimed is:

1. A construction machine comprising:

an automotive lower traveling structure driven by a traveling motor;

an upper revolving structure rotatably mounted on said lower traveling structure and provided with a prime mover on a rear position of said upper revolving structure for driving a hydraulic pump; and a front device provided at a front-part position of said upper revolving structure and movable upwardly and downwardly by a front device actuator, in which said upper revolving structure is composed of:

a revolving frame having a flat plate-shaped bottom plate and forming a support structural body, a control valve block mounting plate provided on said revolving frame, and a control valve block collectively mounted on said control valve block mounting plate and composed of a plurality of directional control valves for controlling the supply and discharge of a pressurized oil from said hydraulic pump to said traveling motor and to said front device actuator, characterized in that:

at least first and second support members are provided at first and second positions having substantially equal distances sandwiching a center position of gravity of said control valve block and on a back surface of said control valve block mounting plate and facing said bottom plate of said revolving frame, each of said at least first and second support members is formed as a frame body having a U-shaped section with an upper side as an open end fixed to said back surface of said control valve block mounting plate and having a lower side as a mounting surface mounted on said bottom plate of said revolving frame, and a weight-reducing part for reducing the weight of the bottom plate is provided on said bottom plate of said revolving frame at a position different from the position where said mounting surface of each of said at least first and second support members is mounted on said bottom plate.

2. The construction machine according to claim 1, wherein said weight-reducing part is constituted by one of a through hole penetrating the bottom plate of said revolving frame and a recessed groove recessed on said bottom plate of said revolving frame.

3. The construction machine according to claim 1, wherein a support beam is provided adjacent said weight-reducing part on said bottom plate of said revolving frame, and each of said at least first and second support members is mounted on said support beam.

4. The construction machine according to claim 1, wherein each of said at least first and second support members is provided on said back surface of said control valve block mounting plate at the first and second positions having the substantially equal distances in one of a front-rear direction or a left-right direction by sandwiching said center position of gravity;

a support beam for mounting each of said support members is provided on said bottom plate of said revolving frame; and said weight-reducing part is configured to be provided on a portion of said bottom plate of said revolving frame excluding said support beam.

5. The construction machine according to claim 3, wherein said revolving frame comprises said bottom plate extending in a front-rear direction of said revolving frame, right and left vertical plates installed upright on the bottom plate and extending in the front-rear direction of the revolving frame while being faced in a left-right direction of the revolving frame, and a lateral plate installed upright in an intermediate portion in the front-rear direction of said bottom plate and extending in the left-right direction from said right vertical plate beyond said left vertical plate; and said support beam and said weight-reducing part are provided on a left front corner portion of said revolving frame bottom plate and partitioned by said left vertical plate and said lateral plate in said revolving frame bottom plate.

* * * * *